United States Patent [19]

Warner et al.

[11] 4,291,516

[45] Sep. 29, 1981

[54] PACKAGE REST FOR WRAPPING STATION

[75] Inventors: Norbert C. Warner, Greenville; Fritz F. Treiber, Centerville, both of Ohio

[73] Assignee: Hobart Corporation, Troy, Ohio

[21] Appl. No.: 116,180

[22] Filed: Jan. 28, 1980

[51] Int. Cl.[3] ..... B65B 67/10; B65B 11/02

[52] U.S. Cl. ..... 53/219; 53/201; 53/390; 108/62; 108/90

[58] Field of Search ..... 53/219, 218, 390, 201; 108/90, 62, 12, 13, 28, 64; 211/135

[56] References Cited

U.S. PATENT DOCUMENTS

| | | | |
|---|---|---|---|
| 2,635,672 | 4/1953 | Rumsey, Jr. | 53/219 X |
| 2,954,654 | 10/1960 | Arvidson | 53/219 X |
| 2,962,853 | 12/1960 | Howe, Jr. | 53/219 X |
| 2,974,458 | 3/1961 | Muskat et al. | 53/390 X |
| 3,093,944 | 6/1963 | Arvidson | 53/390 X |
| 3,358,420 | 12/1967 | Fellner et al. | 53/390 |
| 3,367,589 | 2/1968 | Chant, Jr. et al. | 53/390 UX |
| 3,516,228 | 6/1970 | Fellner | 53/219 X |
| 3,570,215 | 3/1971 | Palmer et al. | 53/390 X |
| 3,579,949 | 5/1971 | Michels | 53/219 X |
| 3,589,633 | 6/1971 | Young et al. | 242/55.3 |
| 3,722,177 | 3/1973 | Michels | 53/390 |
| 3,724,167 | 4/1973 | Pizmoht | 53/390 |

*Primary Examiner*—Horace M. Culver

*Attorney, Agent, or Firm*—Biebel, French & Nauman

[57] ABSTRACT

A unitary package rest member for use on a wrap station is comprised of a central section (42) which can be mounted in at least two different positions to the wrap station, and first and second shelves (44, 45) extending from the central section parallel to each other, spaced apart, and of substantially different area in order to provide to the operator a selection of mounting the rest member with either the smaller or larger shelf in the active operating rest position. The shelf parts extend in opposite directions from the central section, such that the rest shelf not in use projects inwardly under the top section of the wrap station, out of the way of the operator. The rest member can be formed by bending a unitary blank of sheet metal such that the shelf parts are parallel to each other, extending in opposite directions, and the sides of the blank are so dimensioned, in symmetrical fashion, that the blanks may be struck from a strip or sheet of the material with minimum waste.

7 Claims, 7 Drawing Figures

PRIOR ART

PACKAGE REST FOR WRAPPING STATION

BACKGROUND OF THE INVENTION

This invention relates to improvements in a wrap station which is used for wrapping articles, usually food commodities, with a wrapping material. Typically such stations comprise a frame which supports one or more rolls of the material used for wrapping, usually polyvinyl chloride (PVC) film. There are guides over which the film is led from the roll to the top of the station, and thence forward over a cutoff device. The top of the station is a flat table-like surface, and projecting forwardly from the top, beyond the cutoff device, is a package rest. In a typical operation a person using the station places the item to be wrapped on the top, grasps the end of the film and moves it away from him over the item on table surface, then lifts the item and brings it forward to the rest, carrying the trailing film over the cutoff device where it is severed. The sides of the wrapping material are then tucked under the package and fastened, for example with a heat sealing tool, or by placing it briefly on a hot plate for this purpose.

The aforementioned rest is a thin sheet metal shelf-like device which extends forward in cantilever fashion toward the operator, and it usually includes an integral downwardly bent supporting leg which is fastened to the front of the wrap station. Depending upon the dimensions of the articles being wrapped, an auxiliary rest may be provided which is of greater width and which has either a clamp or spring clip arrangement on its bottom to fit onto the narrower rest, thereby providing the operator with additional width in handling larger packages. This wider attachment rest piece is optional, and when detached, like any such device, is inclined to be misplaced or mistreated. The present invention provides a unique package rest member which can be mounted in different positions on the wrap station in order to present wider or narrower rest shelves for use as selected by the operator.

SUMMARY OF THE INVENTION

The present invention, therefore, provides a package rest member for use on a wrap station, wherein a unitary rest member is comprised of a central section which can be mounted in at least two different positions to the wrap station, and first and second shelves extending from the central section in generally transverse relation to the same and substantially parallel to each other, spaced apart, and of substantially different area in order to provide to the operator a selection of mounting the rest member with either the smaller or larger shelf in the active operating rest position. In a preferred embodiment of the device the shelf parts extend in opposite directions from the central section, such that the rest shelf not in use projects inwardly under the top section of the wrap station, out of the way of the operator. The preferred configuration includes a rest member which is formed by bending a unitary blank of sheet metal or the like, such that the shelf parts are parallel to each other, extending in opposite directions as mentioned, and the sides of the blank are so dimensioned, in symmetrical fashion, that the blanks may be struck from a strip or sheet of the material with minimum waste.

The primary object of the invention, therefore, is to provide such a novel rest member comprising a central section that can be mounted in at least two different positions on the wrap station, and having spaced apart parallel rest shelves extending therefrom and of substantially different area, such that the operator can mount the entire rest member in different positions to bring the desired rest shelf into the operative location; to provide such a rest member wherein the shelf parts extend in opposite directions from the central mounting section, whereby the rest shelf not in use is located in a stored position out of the way of the operator; and to provide such a novel rest member which may be constructed from a unitary piece of sheet metal or the like, preferably having symmetrical side configurations which enable the blanks from which the rest members are formed to be economically separated from a sheet of the material.

Other objects and advantages of the invention will be apparent from the following description, the accompanying drawings and the appended claims.

DESCRIPTION OF THE PREFERRED EMBODIMENT

Figure 1:
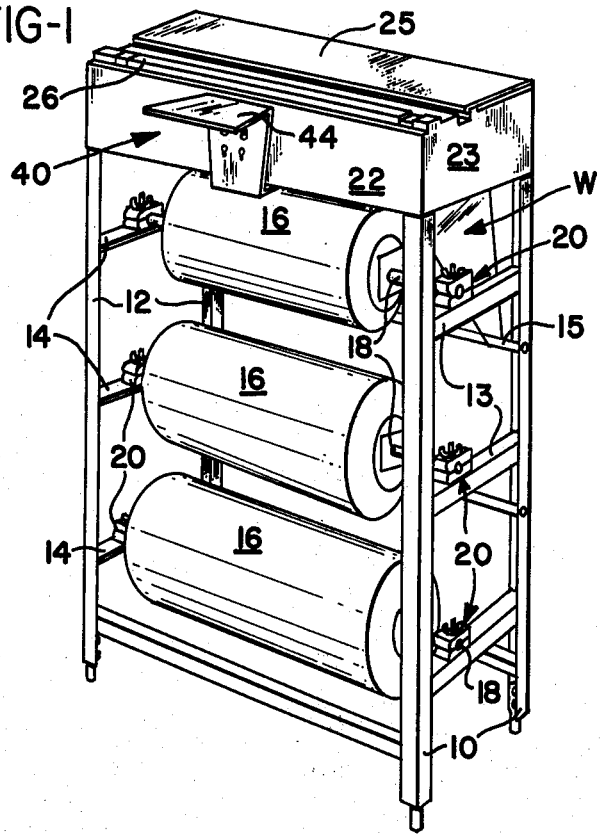
FIG. 1 is a perspective view of a typical wrap station.
Figure 2:
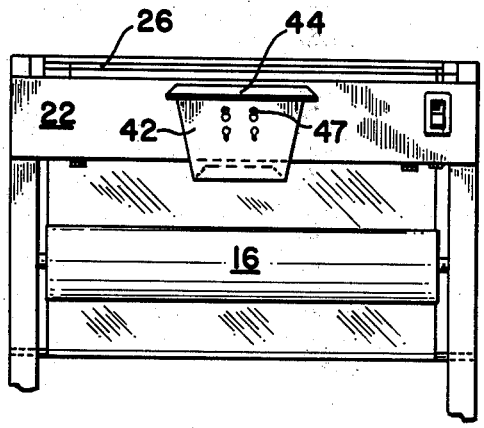
FIG. 2 is a front view of the upper portion of the wrap station.

Referring to FIG. 1, a stand is formed of legs 10 and 12 between which cross members 13, 14 and 15 extend. The space between the front legs provides loading access for several rolls 16 of wrapping material W, such as 55–75 gage polyvinyl chloride sheet. These rolls are held on shafts 18 which in turn are supported in end blocks 20 fastened to the side cross members 13 and 14.

Figure 3:
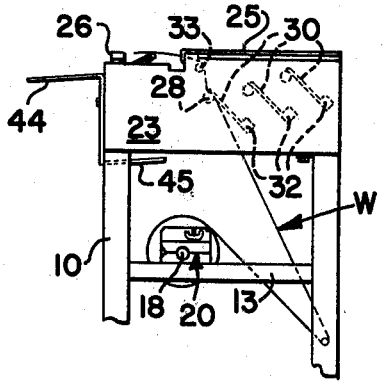
FIG. 3 is a side view of the upper portion of the wrap station.

The top of the station includes a box-like sheet metal structure providing a wrapping station with a front wall 22, sides 23, and rear (not designated) which is mounted on the legs, and which has an openable top 25. At the forward edge of the top is a transversely extending electrically heated cut-off bar 26, which will melt and sever the portion of wrapping material brought into contact with the bar. A plurality of guide bars 28 extend between sides 23, and retainer vanes or plates 30 cooperate with these bars to hold wrapping material passed therebetween as shown in FIG. 3. The vanes are carried by rotatably mounted rods 32, and rest partly over the top of the guide bars. As shown, there preferably is a set (rod and vane) for each supply roll, and the web of material passing through any set extends over an upper front guide rod 33 and through the space between the cut-off bar 26 and the forward edge of top 25.

In use, an item to be wrapped is placed on top 25, and the material W is drawn upward and then backward over the item, and tucked behind the rear of the item. The wrapping operator then picks up the item and moves it forward, pulling the now trailing web into contact with cut-off bar 26, whereby it is severed. At this point the partially wrapped item is moved onto a package rest, the improvement of which is the subject of the invention.

Figure 7:
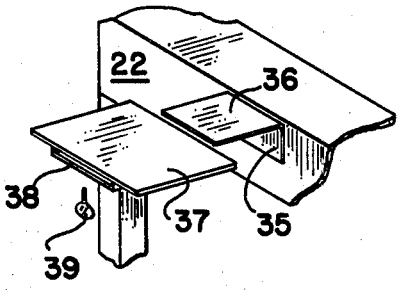
FIG. 7 is a perspective view of a prior art package rest member.

A typical prior art rest is shown in FIG. 7. It comprises an inverted L-shaped sheet metal member having an upwardly extending part 35 and a forwardly extending part 36 which is somewhat narrower than the items to be wrapped. The part 35 is suitably mounted to the front wall 22, and the shelf part 36 extends in cantilever fashion outward toward the operator. The part 36 supports the center of a partially wrapped item, allowing material at the sides of the item to be gathered and tucked beneath it. The packaged item can then be sealed, if necessary, in any suitable way.

For larger items, an auxiliary shelf 37 is provided as a separate piece. In one form, as seen in FIG. 7, the auxiliary shelf 37 has a narrow receiver part 38 secured to its bottom and adapted to fit over part 36. A thumbscrew 39 is used to clamp the auxiliary shelf 37 in place when it is used. In another form of the shelf (not shown), a pair of spring clips secured to its bottom are adapted to fit over part 36 and removably clamp the shelf 37 to the part 36. When not needed these parts must be stored in some readily accessible location, but, in the typical work environment, they are often lost, misplaced, or damaged.

The present invention provides a unitary reversible package rest member 40 which may readily be formed from sheet metal (such as stainless steel). It includes a central section 42 of approximately the same, or slightly greater, height as front wall 22. The rest member 40 also includes first and second shelf parts 44, 45 which extend from the central section 42 in generally transverse relation thereto and in spaced relation to one another. More particularly, the first shelf part 44 extends at a predetermined angle from one end of the central section 42, and the second shelf part 45 extends at about the same angle from the other end of section 42, preferably in the opposite direction from, and parallel to, part 44.

Part 44 is substantially greater in width than part 45, thus providing in one piece a larger and a smaller package rest or shelf. A pair of spaced apart headed studs 47 extend from front wall 22, and the central section has keyhole shaped slots 48 and 49 arranged in opposite pairs spaced equally from the respective shelf parts (FIG. 4) to fit over the studs and to support the desired part 44 or 45 in operative position at the same elevation, extending outward in cantilever fashion from wall 22 while the other part extends under the top as shown in FIG. 5.

Figure 4:
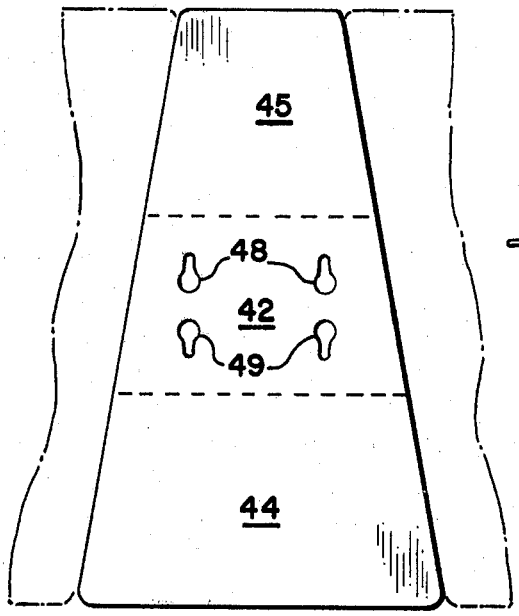
FIG. 4 is a plan view of a blank from which the rest member is formed.
Figure 5:
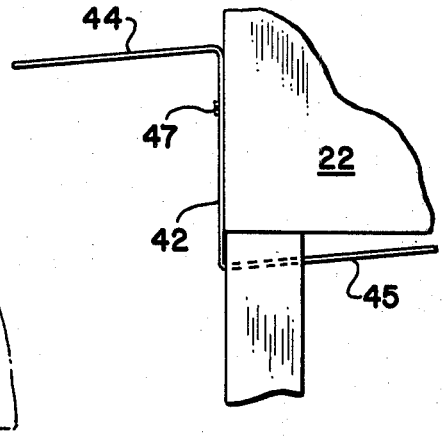
FIG. 5 is a side view of the rest member showing the configuration of the central section and the respective larger and smaller rest shelves extending therefrom.

The blank shape of member 40, before it is bent to the desire Z-shape, is shown in FIG. 4. It will be noted that this shape is symmetrical, and the member can be cut from a large sheet with minimum waste, then shaped as desired. Portions of additional members are shown in dash lines.

Figure 6:
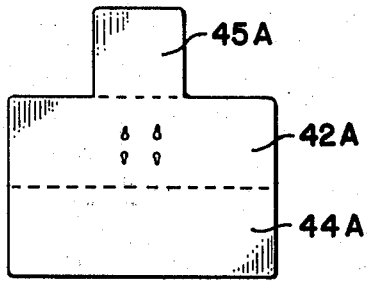
FIG. 6 is a view of a blank illustrating the configuration of a modified form of rest member.

FIG. 6 shows another form of the novel package rest member. Here the central section 42A is of the same width as the larger shelf part 44A, and the smaller shelf part 45A extends from the center of the opposite edge of the center section. The dash lines indicate the location of the bends or folds to shape the blank to essentially the same angles as in the preferred embodiment. The blank shown in FIG. 6 also lends itself to economical cutting from a large sheet.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. For use with a wrapping device including a stand for supporting a roll of wrapping material and means guiding the material from the roll to a wrapping station,
a package rest member comprising a central section,
first and second shelves extending from said central section in generally transverse relation to said central section and in spaced relation to one another,
one of said shelves being substantially greater in area than the other shelf,
and reversible mounting means on said rest member permitting selective mounting thereof to the stand with either one of said shelves in operative position at the wrapping station and the other shelf located below the wrapping station.

2. A rest member as defined in claim 1, wherein
said first and second shelves extend in opposite directions from said central section
whereby the other shelf is located below and extending away from the person using the wrapping station.

3. A rest member as defined in claims 1 or 2,
said rest member being formed of a single piece of sheet metal.

4. A rest member as defined in claims 1 or 2,
said rest member being formed of a sheet metal blank having symmetrical sides and being bent along substantially parallel lines at the joint of said shelves to said central section.

5. A rest member as defined in claims 1 or 2,
said mounting means being parallel elongated slots in said central section with enlarged openings to fit over headed mounting studs on the stand.

6. A rest member as defined in claims 1 or 2, wherein
said first shelf extends at a predetermined angle from said central section,
and said second shelf extends at approximately the same predetermined angle from said central section.

7. A rest member as defined in claims 1 or 2, said mounting means being defined in said central section of said rest member substantially equidistant from said shelf parts, and
whereby each one of said shelf parts will assume the same location with respect to said stand when disposed in the operative position at the wrapping station.

* * * * *